US011565310B2

(12) United States Patent
Han et al.

(10) Patent No.: US 11,565,310 B2
(45) Date of Patent: Jan. 31, 2023

(54) PREPARATION METHOD OF FOAMED ALUMINUM SPECIAL-SHAPED PART

(71) Applicant: CITIC Dicastal Co., Ltd., Qinhuangdao (CN)

(72) Inventors: Xing Han, Qinhuangdao (CN); Haifeng Liu, Qinhuangdao (CN); Yu Sun, Qinhuangdao (CN); Yugang Gao, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 0 days.

(21) Appl. No.: 17/387,966

(22) Filed: Jul. 28, 2021

(65) Prior Publication Data

US 2022/0134419 A1 May 5, 2022

(30) Foreign Application Priority Data

Nov. 3, 2020 (CN) ..... 2020112062771.1

(51) Int. Cl.

| | |
|---|---|
| ***B22D 25/00*** | (2006.01) |
| ***B22C 3/00*** | (2006.01) |
| ***B22C 13/08*** | (2006.01) |
| ***B22D 21/04*** | (2006.01) |
| ***B22D 27/04*** | (2006.01) |
| ***B22D 27/08*** | (2006.01) |

(52) U.S. Cl.

CPC ..... *B22D 25/005* (2013.01); *B22C 3/00* (2013.01); *B22C 13/08* (2013.01); *B22D 21/04* (2013.01); *B22D 27/04* (2013.01); *B22D 27/08* (2013.01)

(58) Field of Classification Search

CPC ..... B22D 25/005; B22D 21/04; B22D 27/04; B22D 27/08; B22D 7/02; B22D 7/023; B22D 7/026; B22C 3/00; B22C 13/08; B22C 9/04; B22C 9/043; B22C 7/02; B22C 7/023; B22C 7/026

See application file for complete search history.

(56) References Cited

U.S. PATENT DOCUMENTS 5,465,780 A * 11/1995 Muntner ..... B28B 11/12 164/369
5,632,319 A * 5/1997 Yang ..... B22D 25/005 164/79
2016/0221072 A1* 8/2016 Breneman ..... B22C 9/22

* cited by examiner

*Primary Examiner* — Kevin P Kerns
*Assistant Examiner* — Steven S Ha
(74) *Attorney, Agent, or Firm* — IPro, PLLC

(57) ABSTRACT

Disclosed is a preparation method of a foamed aluminum special-shaped part. The preparation method comprises the following steps: S1, pressing wax molds; S2, making a shell; S3, carrying out smelting; S4, carrying out casting; and S5, vibrating the shell. Finally, the foamed aluminum special-shaped part is obtained for a preparation process of a foamed aluminum compound casting.

6 Claims, 2 Drawing Sheets

PREPARATION METHOD OF FOAMED ALUMINUM SPECIAL-SHAPED PART

FIELD

The present disclosure relates to the technical field of aluminum alloy castings, in particular to a preparation method of the foamed aluminum special-shaped part.

BACKGROUND

A foamed aluminum material is a novel light multifunctional material in which a large number of communicating or non-communicating holes are uniformly distributed in an aluminum or aluminum alloy matrix, and has the characteristics of a continuous metal phase and a dispersed air phase. As a structural material, foamed metal has the characteristics of small density, high porosity, large specific surface area and the like; as a functional material, the foamed metal has multiple properties of porosity, vibration reduction, damping, sound absorption, sound insulation, heat dissipation, impact energy absorption, electromagnetic shielding and the like. The foamed metal material has the dual functions of the structural material and the functional material, is beneficial to realizing light weight of products and improving collision safety and buffering performance, can also comply with the industrial green manufacturing concept, can obviously improve the NVH performance of the whole machine/whole vehicle, and therefore is widely applied to the fields of automobile industry, rail transit, aerospace, electronic military industry and the like.

At present, research and application of foamed aluminum at home and abroad mainly focus on research on foamed aluminum plates or sandwich plates taking foamed aluminum as a core material, foamed aluminum special-shaped parts are rarely reported, but foamed aluminum products in regular shapes such as a plate shape, a rod shape and a column shape cannot meet the requirements for integration and complication of parts. The current preparation process for a foamed aluminum special-shaped part mainly comprises machining+bonding, a melt foaming method and a powder metallurgy method.

The foamed aluminum special-shaped part is prepared through a machining+bonding process, the process is simple, easy to operate and low in investment, but has miscellaneous working procedures, involves multiple machining procedures, and is low in product yield, and due to the fact that the surface of the foamed aluminum special-shaped part is of a hole structure, high failure risk exists when the foamed aluminum special-shaped part is connected with an mating part, and automation is hardly achieved. The melt foaming method is simple and mature in process and low in cost, but if the melt foaming method is used for a special-shaped part, a corresponding metal mold is needed, and the service life of the mold may be greatly shortened under the working conditions of repeated heating and chilling, so that the manufacturing cost of the product is remarkably increased. The powder metallurgy method has the characteristics of short process and near-net forming, has incomparable advantages compared with other processes when used for preparing special-shaped parts with complex shapes, but also has some prominent problems such as high raw material cost, complex preform preparation process, too short service life of a metal cavity for foaming, and thus, the powder metallurgy method has great limitation when applied to industrial production.

SUMMARY

In view of this, the present disclosure aims to provide preparation of a foamed aluminum special-shaped part in a specific shape with short process and low cost.

In order to achieve the above object, the technical solution of the present disclosure is implemented in the following way.

A preparation method of a foamed aluminum special-shaped part comprises the following steps:

S1, pressing wax molds, specifically, designing and manufacturing a profiling mold according to the requirements of the foamed aluminum special-shaped part, pressing a fusible material into the wax molds by using the profiling mold, and welding the multiple wax molds on a wax casting system to form a wax mould;

S2, making a shell, specifically, soaking the wax mould into a coating prepared from sodium silicate and quartz powder, taking out the wax mould, scattering quartz sand on the wax mould, hardening the wax mould in a hardening agent, repeating the steps for multiple times until a hardened shell with a certain thickness is formed on a surface of the wax mould, heating the wax mould with the hardened shell in hot water at 80-90° C., enabling the wax mould to flow out from a sprue after being molten to form a casting cavity so as to obtain a shell, drying and roasting the shell, carrying out sand filling around the shell, carrying out preheating, and waiting for casting;

S3, carrying out smelting, specifically, carrying out melting, refining, component adjustment, refining and modifying, slag and hydrogen measurement, and standing for heat preservation, adding a tackifier, carrying out uniform stirring, adding a foaming agent, and carrying out uniform stirring;

S4, carrying out casting, specifically, quickly casting a metal melt to be foamed into the preheated shell, carrying out heat preservation, carrying out sufficient foaming, and then taking out and cooling the shell; and S5, vibrating the shell, specifically, vibrating the shell by adopting a shell vibrating machine, wherein a shell vibrating portion is positioned at a sprue cup.

In some embodiments, the temperature of roasting in step S2 is 850-950° C.

In some embodiments, the tackifier in step S3 is Ca, the adding amount is 0.6-2.0% of the mass of the melt, the tackifying temperature is 700-750° C., the stirring speed is 500-800 r/min, and the stirring time is 180-300 s.

In some embodiments, the foaming agent in step S3 is $TiH_2$, the adding amount is 0.8-2.5% of the mass of the melt, the foaming temperature is 680-720° C., the stirring speed is 900-1500 r/min, and the stirring time is 30-60 s.

In some embodiments, the shell in step S4 is preheated to the temperature of 680-750° C., the foamed aluminum special-shaped part with the shell is cooled by strong air mist, and the cooling time is 60-120 s.

In some embodiments, the foamed aluminum special-shaped part obtained after step S5 is completed is cleaned by using a NaOH aqueous solution with the mass fraction of 10%, after the foamed aluminum special-shaped part is air-dried, a soldering flux is sprayed to the surface of the foamed aluminum special-shaped part, and the soldering flux is a potassium fluozirconate aqueous solution with the concentration of 3-10%.

Compared with the prior art, the preparation method of the foamed aluminum special-shaped part of the present disclosure has the following advantages:

(1) short process: the preparation method of the present disclosure is based on the melt foaming method, the foamed aluminum special-shaped part is directly formed at a time, the working procedures of machining, bonding, preform preparation and the like are not needed, the preparation method is simple to operate, and industrialization is easy to achieve; and (2) low cost: high-temperature foaming and then cooling for solidification are required in the foamed aluminum preparation process, so that the influence on the service life of a foaming mold is great, but in the preparation method of the present disclosure, the foaming device adopts a cheap shell in investment casting, the cost for an expensive metal mold is omitted, and the production cost is remarkably reduced.

DETAILED DESCRIPTION OF THE EMBODIMENTS

The accompanying drawings which form a part of the utility model are used for providing a further understanding of the utility model, and the illustrative embodiments of the utility model and the description thereof are used for explaining the utility model and do not constitute an inappropriate limitation of the utility model. In the accompanying drawings.

Figure 1:
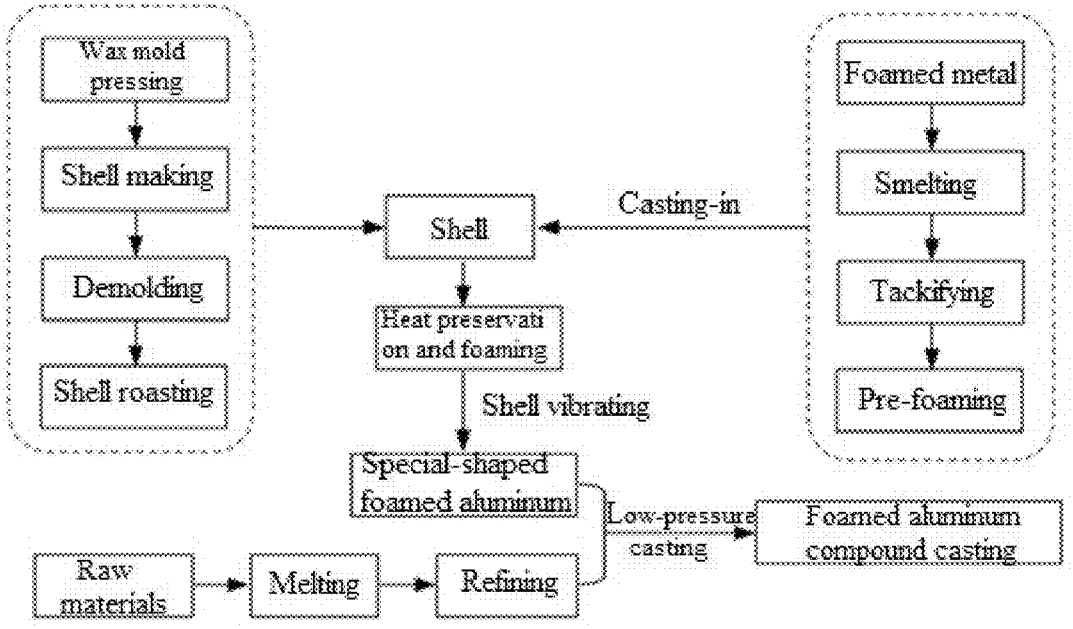
FIG. 1 is a flow chart of a preparation method of a foamed aluminum special-shaped part of an embodiment of the present disclosure.

It needs to be noted that embodiments of the present disclosure and features in the embodiments may be combined with each other without conflict.

The technical solutions of the present disclosure will be described below clearly and completely with reference to the accompanying drawings and the embodiments, and obviously, the described embodiments are only a part of the embodiments of the present disclosure, and not all of the embodiments. All other embodiments, which can be obtained by a person of ordinary skill in the art without making any creative effort based on the embodiments in the present disclosure, belong to the scope of protection of the present disclosure.

A preparation method of a foamed aluminum special-shaped part comprises the following steps: S1, wax molds are pressed, specifically, a profiling mold is designed and manufactured according to the requirements of the foamed aluminum special-shaped part, a fusible material is pressed into the wax molds by using the profiling mold, and the multiple wax molds are welded on a wax casting system to form a wax mould; S2, a shell is made, specifically, the wax mould is soaked into a coating prepared from sodium silicate and quartz powder, the wax mould is taken out, quartz sand is scattered to the wax mould, the wax mould is placed into a hardening agent to be hardened, the steps are repeated for multiple times until a hardened shell with a certain thickness is formed on a surface of the wax mould, the wax mould with the hardened shell is placed into hot water at 80-90° C. to be heated, so that the wax mould flows out from a sprue after being molten to form a casting cavity so as to obtain a shell, the shell is dried and roasted, the roasting temperature is 850-950° C., then sand filling is carried out around the shell, and the shell is preheated to be cast; S3, smelting is carried out, specifically, melting, refining (gas and slag removal), component adjustment, refining and modifying, slag and hydrogen measurement, and standing for heat preservation are carried out, a tackifier which is Ca is added, the adding amount of the tackifier is 0.6-2.0% of the mass of a melt, the tackifying temperature is 700-750° C., the stirring speed is 500-800 r/min, the stirring time is 180-300 s, uniform stirring is carried out, then a foaming agent which is TiH2 is added, the adding amount of the foaming agent is 0.8-2.5% of the mass of the melt, the foaming temperature is 680-720° C., the stirring speed is 900-1500 r/min, the stirring time is 30-60 s, and uniform stirring is carried out; S4, casting is carried out, specifically, a metal melt to be foamed is quickly cast into the preheated shell, heat preservation is carried out, the shell is taken out and cooled after being sufficiently foamed, the shell is preheated to the temperature of 680-750° C., the foamed aluminum special-shaped part with the shell is cooled by strong air mist, and the cooling time is 60-120 s; and S5, the shell is vibrated, specifically, the shell is vibrated by adopting a shell vibrating machine, and a shell vibrating portion is positioned at a sprue cup.

The foamed aluminum special-shaped part obtained after the shell is vibrated is cleaned by using a NaOH aqueous solution with the mass fraction of 10% before casting, after the foamed aluminum special-shaped part is air-dried, a soldering flux is sprayed to the surface of the foamed aluminum special-shaped part, the soldering flux is a potassium fluozirconate aqueous solution with the concentration of 3-10%, and a casting process may be gravity casting, low-pressure casting or counter-pressure casting.

Embodiment 1

Figure 2:
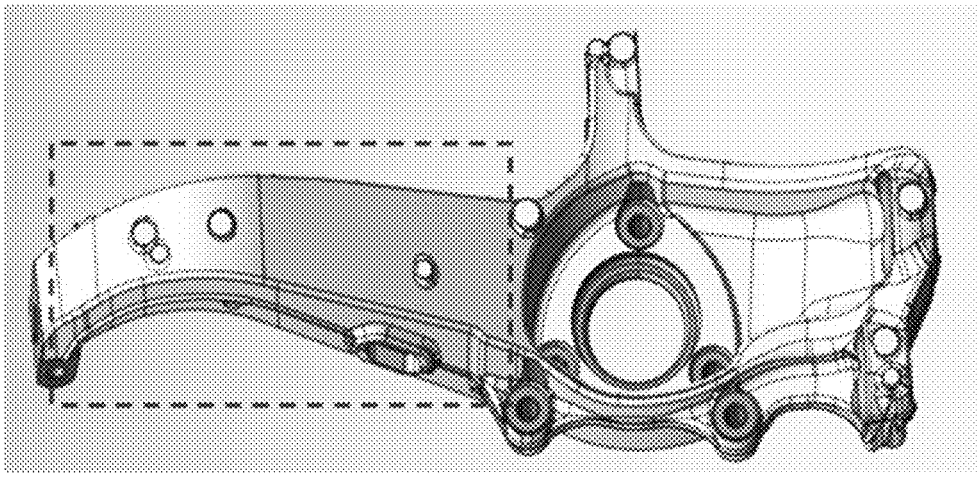
FIG. 2 is a schematic diagram of a knuckle of a cavity casting of an embodiment of the present disclosure.
Figure 3:
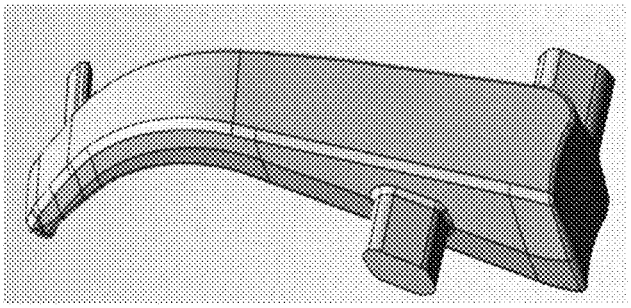
FIG. 3 is a schematic diagram of a foamed aluminum special-shaped part in the knuckle of the cavity casting of an embodiment of the present disclosure.

A certain vehicle chassis aluminum alloy cavity casting-a knuckle: the overall dimension of the casting is 550*160*240 mm, the used alloy is A356, the weight is 4.25 Kg, the basic wall thickness is 6 mm, and as shown in FIG. 2, a foamed aluminum filling position is shown in a dotted line frame in the figure; and foamed aluminum is filled, with an overall dimension of 300*150*150 mm, the material is pure aluminum with the weight of 0.21 Kg and the isovolumetric density of 0.2-0.4 g/cm$^3$, as shown in FIG. 3. The casting process is low-pressure casting.

The whole process is divided into three parts including shell preparation, foamed melt preparation and low-pressure casting, and as shown in FIG. 1, the preparation method comprises the following specific steps:

S1, wax molds are pressed, specifically, a profiling mold is designed and manufactured according to the requirements of the foamed aluminum special-shaped part, a fusible material is pressed into the wax molds by using the profiling mold, and the multiple wax molds are welded on a wax casting system to form a wax mould;

S2, a shell is made, specifically, the wax mould is soaked into a coating prepared from sodium silicate and quartz powder, the wax mould is taken out, quartz sand is scattered to the wax mould, the wax mould is placed into a hardening agent to be hardened, the steps are repeated for multiple times until a hardened shell with a certain thickness is formed on a surface of the wax mould, the wax mould with the hardened shell is placed into hot water at 80-90° C. to be heated, so that the wax mould flows out from a sprue after being molten to form a casting cavity so as to obtain the shell, after the shell is dried and roasted (heated to the temperature of 850-950° C.), sand filling is carried out around the shell, and the shell is preheated to be cast;

S3, smelting is carried out, specifically, melting, refining (gas and slag removal), component adjustment, refining and modifying, slag and hydrogen measurement, and standing for heat preservation are carried out, a tackifier is added, uniform stirring is carried out, then a foaming agent is added, and uniform stirring is carried out;

S4, casting is carried out, specifically, a metal melt to be foamed is quickly cast into the preheated shell, heat preservation is carried out, the shell is taken out and cooled after being sufficiently foamed; and S5, the shell is vibrated, specifically, the shell is vibrated by adopting a shell vibrating machine, and a shell vibrating portion is positioned at a sprue cup.

In the above smelting procedure, the tackifier is Ca, the adding amount of the tackifier is 0.8% of the mass of the melt, the tackifying temperature is 740° C., the stirring speed is 750 r/min, and the stirring time is 280 s.

Further, the foaming agent is TiH2, the adding amount of the foaming agent is 1.2% of the mass of the melt, the foaming temperature is 700° C., the stirring speed is 1200 r/min, and the stirring time is 50 s.

In the above casting procedure, the shell is preheated to the temperature of 720° C., the foamed aluminum special-shaped part with the shell is cooled by strong air mist, and the cooling time is 100 s.

The foamed aluminum compound casting is produced by adopting the preparation method of the foamed aluminum special-shaped part, the casting process may be gravity casting, low-pressure casting and counter-pressure casting, the foamed aluminum special-shaped part is cleaned by using the NaOH aqueous solution with the mass fraction of 10% before casting, after the foamed aluminum special-shaped part is air-dried, the soldering flux is sprayed to the surface of the foamed aluminum special-shaped part, and the soldering flux is the potassium fluozirconate aqueous solution with the concentration of 5%.

Compared with the prior art, the preparation method of the foamed aluminum special-shaped part has the following advantages:

(1) short process: the preparation method of the present disclosure is based on the melt foaming method, the foamed aluminum special-shaped part is directly formed at a time, the working procedures of machining, bonding, preform preparation and the like are not needed, the preparation method is simple to operate, and industrialization is easy to achieve; and (2) low cost: high-temperature foaming and then cooling for solidification are required in the foamed aluminum preparation process, so that the influence on the service life of a foaming mold is great, but in the preparation method of the present disclosure, the foaming device adopts a cheap shell in investment casting, the cost for an expensive metal mold is omitted, and the production cost is remarkably reduced.

In the description of the present invention, it should be understood that the terms "center", "longitudinal", "transverse", "front", "rear", "left", "right", "vertical", "horizontal", "top", "bottom", "inner", "outer", and the like indicate orientations or positional relationships based on the drawings. The terms are only for description convenience of the present invention and simplification of the description, but do not indicate or imply that the pointed apparatuses or elements must have specific orientations or be constructed and operated in specific orientations. Therefore, the terms should not be understood to limit the present invention.

Furthermore, the terms "first" and "second" are only for the aim of description, and cannot be understood as indicating or implying the relative importance or implicitly indicating the quantity of the indicated technical features. Thus, the features defined with "first" and "second" may explicitly or implicitly comprise one or more of these features. In the description of the present invention, "a plurality of" means at least two, e.g., two, three, etc., unless otherwise specified.

In the present invention, unless otherwise specified and defined, the terms "mounted", "joined", "connected", "fixed" and the like should be understood in a broad sense, for example, being fixedly connected, detachably connected, integrated; mechanically connected, electrically connected, mutually communicated; directly connected, indirectly connected by a medium, communication of interiors of two components or interaction of two components. A person of ordinary skill in the art could understand the specific meanings of the above terms in the present invention according to specific circumstances.

The foregoing descriptions are merely preferred embodiments of the present invention, but are not intended to limit the present invention. Any modification, equivalent substitution, improvement and the like made within the spirit and principle of the present invention shall fall within the protection scope of the present invention.

What is claimed is:

1. A preparation method of a foamed aluminum special-shaped part, comprising the following steps:

S1, pressing wax molds, by designing and manufacturing a profiling mold according to the requirements of the foamed aluminum special-shaped part, pressing a fusible material into the wax molds by using the profiling mold, and welding the multiple wax molds on a wax casting system to form a wax mould;

S2, making a shell, by soaking the wax mould into a coating prepared from sodium silicate and quartz powder, taking out the wax mould, scattering quartz sand to the wax mould, hardening the wax mould in a hardening agent, repeating the steps for multiple times until a hardened shell with a certain thickness is formed on a surface of the wax mould, heating the wax mould with the hardened shell in hot water at 80-90° C., enabling the wax mould to flow out from a sprue after being molten to form a casting cavity so as to obtain the shell, drying and roasting the shell, carrying out sand filling around the shell, carrying out preheating, and waiting for casting;

S3, carrying out smelting, by carrying out melting, refining, component adjustment, refining and modifying, slag and hydrogen measurement, and standing for heat preservation, adding a tackifier, stirring, adding a foaming agent, and stirring;

S4, carrying out casting, by casting a metal melt to be foamed into the preheated shell, carrying out heat preservation, carrying out sufficient foaming, and then taking out and cooling the shell; and S5, vibrating the shell, by vibrating the shell by adopting a shell vibrating machine, wherein a shell vibrating portion is positioned at a sprue cup.

2. The preparation method of the foamed aluminum special-shaped part according to claim 1, wherein the roasting in step S2 is performed at a temperature of 850-950° C.

3. The preparation method of the foamed aluminum special-shaped part according to claim 1, wherein the tackifier in step S3 is Ca, and is added with an adding amount of 0.6-2.0% of the mass of the melt and at a tackifying temperature of 700-750° C., the stirring after adding the tackifier and before adding the foaming agent is performed at a stirring speed of 500-800 r/min and a stirring time of 180-300 s.

4. The preparation method of the foamed aluminum special-shaped part according to claim 1, wherein the foaming agent in step S3 is $TiH_2$, and is added with an adding amount of 0.8-2.5% of the mass of the melt and at a foaming temperature of 680-720° C., the stirring after adding the foaming agent is performed at a stirring speed of 900-1500 r/min and a stirring time of 30-60 s.

5. The preparation method of the foamed aluminum special-shaped part according to claim 1, wherein the shell in step S4 is preheated to 680-750° C., the foamed aluminum special-shaped part with the shell is cooled by wind mist cooling, with a cooling time of 60-120 s.

6. The preparation method of the foamed aluminum special-shaped part according to claim 1, furthering comprising:

cleaning the foamed aluminum special-shaped part obtained after step S5 is completed by using a NaOH aqueous solution with a mass fraction of 10%;

air-drying the foamed aluminum special-shaped part; and spraying a soldering flux to surface of the foamed aluminum special-shaped part, and the soldering flux is a potassium fluozirconate aqueous solution with a concentration of 3-10%.

* * * * *